US012702231B2

(12) United States Patent
Deng et al.

(10) Patent No.: US 12,702,231 B2
(45) Date of Patent: Aug. 11, 2026

(54) COMPRESSIBLE SECTIONAL SOFA

(71) Applicant: ZHEJIANG GLORY HOME FURNISHINGS CO., LTD., Jiaxing (CN)

(72) Inventors: Zehua Deng, Jiaxing (CN); Jun Ma, Jiaxing (CN); Guohao Qiu, Jiaxing (CN); Daixing Wan, Jiaxing (CN)

(73) Assignee: ZHEJIANG GLORY HOME FURNISHINGS CO., LTD., Jiaxing City (CN)

( * ) Notice: Subject to any disclaimer, the term of this patent is extended or adjusted under 35 U.S.C. 154(b) by 117 days.

(21) Appl. No.: 18/714,580

(22) PCT Filed: Feb. 25, 2022

(86) PCT No.: PCT/CN2022/077801
§ 371 (c)(1),
(2) Date: May 30, 2024

(87) PCT Pub. No.: WO2023/151134
PCT Pub. Date: Aug. 17, 2023

(65) Prior Publication Data

US 2025/0017377 A1 Jan. 16, 2025

(30) Foreign Application Priority Data

Feb. 9, 2022 (CN) ..... 202210119698.3

(51) Int. Cl.
*A47C 4/02* (2006.01)
*A47C 5/00* (2006.01)

(52) U.S. Cl.
CPC ..... *A47C 4/028* (2013.01); *A47C 5/00* (2013.01)

(58) Field of Classification Search
CPC ..... A47C 17/02; A47C 17/00
See application file for complete search history.

(56) References Cited

U.S. PATENT DOCUMENTS 5,102,191 A * 4/1992 Peng ..... A47C 31/02 297/440.1
6,012,188 A 1/2000 Daniels
(Continued)

FOREIGN PATENT DOCUMENTS

CN 2365976 Y 3/2000
CN 2610765 Y 4/2004
(Continued)

OTHER PUBLICATIONS

Translation CN-112205804-A (Year: 2025).*
(Continued)

*Primary Examiner* — J. T. Newton
(74) *Attorney, Agent, or Firm* — Cheng-Ju Chiang

(57) ABSTRACT

A compressible sectional sofa includes seat cushions, armrests, and covers. The seat cushions and the armrests are made of a hard material and of a soft material covering the hard material. The hard material and the soft material are both made of a compressible material. The seat cushions and the armrests are disposed separately. The covers include a seat cushion cover, an armrest cover, a first zipper, and a second zipper. The seat cushion cover includes a top surface, an armrest side surface, and a headrest side surface. When transportation is required, the seat cushions and the armrests can be compressed via a mechanical device, thereby squeezing the air out of the hard material and out of the soft material, thus reducing the volume of the seat cushions and armrests, and further reducing packaging volume and facilitating transportation.

11 Claims, 3 Drawing Sheets

(56) References Cited

U.S. PATENT DOCUMENTS

| | | | | |
|---|---|---|---|---|
| 2012/0217784 | A1* | 8/2012 | Griggs, Jr. | A47C 4/028 297/440.1 |
| 2015/0028649 | A1* | 1/2015 | George, II | A47C 27/087 297/452.17 |
| 2015/0035324 | A1* | 2/2015 | George, II | A47C 27/086 297/188.01 |
| 2016/0120332 | A1* | 5/2016 | Chou | A47C 17/02 53/434 |
| 2021/0145185 | A1 | 5/2021 | Negus | |

FOREIGN PATENT DOCUMENTS

| | | | | | |
|---|---|---|---|---|---|
| CN | 2659257 | Y | | 12/2004 | |
| CN | 101766411 | A | | 7/2010 | |
| CN | 203328300 | U | | 12/2013 | |
| CN | 104545129 | A | | 4/2015 | |
| CN | 204351425 | U | | 5/2015 | |
| CN | 109198953 | A | | 1/2019 | |
| CN | 210276242 | U | | 4/2020 | |
| CN | 112089251 | A | | 12/2020 | |
| CN | 112205804 | A | * | 1/2021 | A47C 17/00 |
| CN | 215533064 | U | | 1/2022 | |
| DE | 202005022070 | U1 | * | 2/2013 | A47C 17/00 |
| TW | 432987 | U | | 5/2001 | |
| TW | M294265 | U | | 7/2006 | |
| WO | 2013141601 | A1 | | 9/2013 | |

OTHER PUBLICATIONS

Translation DE-202005022070-U1 (Year: 2025).*

International Search Report of PCT Patent Application No. PCT/CN2022/077801 issued on Oct. 26, 2022.

The search report of CN patent application No. 2022101196983 issued on Jan. 3, 2023.

The search report of CN patent application No. 2022101196983 issued on May 5, 2023.

* cited by examiner

COMPRESSIBLE SECTIONAL SOFA

CROSS REFERENCE TO RELATED APPLICATIONS

The present disclosure is a 35 U.S.C. § 371 National Phase conversion of International (PCT) Patent Application No. PCT/CN2022/077801, filed on Feb. 25, 2022, which claims priority of Chinese patent application No. CN202210119698.3 filed on Feb. 9, 2022. The entire contents of the above-identified applications are incorporated herein by reference.

TECHNICAL FIELD

The present invention relates to the technical field of daily bedding, in particular to a compressible sectional sofa.

BACKGROUND

Traditional sofa cover are fixed on sofa bodies, and sofa bodies are generally made of metal or wood. Such sofas are very bulky and quite unfriendly to consumers living on high floors, especially for some relatively old-fashioned residential areas, in particular for consumers without elevators or with narrow elevators, moving house is extremely inconvenient. At the same time, with the rise of global e-commerce, sofas have also begun to be delivered to customers or merchants through logistics. However, due to the presence of metal or wood frames in traditional sofas, the loading volume of a single container is small, and the proportion of express logistics cost is significant or the proportion is too large, thereby increasing the cost of products. Especially due to the small loading volume of a single container, needs of users cannot be met.

SUMMARY OF THE DISCLOSURE

In view of this, the present invention provides a compressible sectional sofa that can reduce transported volume.

A compressible sectional sofa comprises at least one seat cushion, at least one armrest disposed at a side of the seat cushion, and a cover body covering outside the seat cushion and the armrest. Both the seat cushion and the armrest are made of hard material and soft material covering the hard material. Both the hard material and the soft material are made of compressed material. The seat cushion and the armrest are disposed separately. The cover body comprises a seat cushion cover body covering on the seat cushion, at least one armrest cover body connected to the seat cushion cover body, a first zipper disposed on the seat cushion cover body and configured to connect between two adjacent seat cushions, and a second zipper respectively disposed on the seat cushion cover body and the armrest cover body and configured to connect the seat cushion cover body and the armrest cover body. The seat cushion cover body comprises a top surface, at least one armrest side surface connected with the top surface, and at least one headrest side surface connected with the top surface. The top surface has at least one top outside edge surface. The armrest side surface has at least one armrest outside edge surface. The headrest side surface has at least one headrest outside edge surface. The first zipper has two first cloth straps. The first cloth strap has a first cloth strap outside surface. The second zipper has two second cloth straps. The second cloth strap has a second cloth strap outside surface. One of the first cloth strap outside surfaces abuts against the top outside edge surface and the headrest outside edge surface. One of the second cloth strap outside surfaces abuts against the armrest outside edge surface. One of the second cloth straps of the second zipper is fixed to the armrest cover body to connect the armrest cover body and the seat cushion cover body.

Furthermore, the compressible sectional sofa comprises multiple seat cushions, the seat cushion cover body on each of the seat cushions comprises two first cloth straps respectively disposed in first zippers at two sides of the seat cushion, and two second cloth straps respectively disposed in second zippers at two sides of the seat cushion.

Furthermore, the hard material is hard sponge.

Furthermore, the soft material is one of flexible sponge and cotton cloth.

Furthermore, one of the first cloth strap outside surfaces is sewn together with the top outside edge surface and the headrest outside edge surface.

Furthermore, one of the second cloth strap outside surfaces abuts against and is sewn together with the armrest outside edge surface, and an opposite side of the first cloth strap outside surface abuts against and is sewn together with an opposite side of the second cloth strap outside surface.

Furthermore, between the hard material and the soft material there is further provided with an adhesive layer.

Furthermore, the hard material and the soft material are integrally formed by injection molding.

Furthermore, the compressible sectional sofa removes air in the hard material and the soft material by compression to reduce the volume of the compressible sectional sofa.

Furthermore, the compressible sectional sofa comprises two seat cushions, the two seat cushions are connected together by the first zipper.

Compared with the prior art, in the compressible sectional sofa provided by the present invention, since both the seat cushion and the armrest are made of compressible hard material and soft material, when transportation is needed, the seat cushion and the armrest can be compressed by machine equipments, such that air in the hard material and the soft material is squeezed out, and volumes of the seat cushion and the armrest are reduced, thus the package volume can be reduced to facilitate transportation; at the same time, during each transportation, the same container can be loaded three to four times more, thereby achieving the purpose of reducing transportation cost. At the same time, since the sofa is composed of the seat cushion and the armrest, how to connect the seat cushion and the armrest and how to ensure the strength between the seat cushion and the armrest are very important, otherwise the compressible sectional sofa is unable to use. Therefore, the cover body uses the zippers to fix the seat cushion and the armrest; in order to improve the connection strength between the seat cushion and the armrest, the first cloth strap outside surface of the first zipper abuts against and is sewn with the armrest outside edge surface, the second cloth strap outside surface abuts against and is sewn with the top outside edge surface, and the opposite surfaces of the first cloth strap outside surface and of the second cloth strap outside surface are sewn, such that when one side of the second zipper at the seat cushion and another side of the second zipper at the armrest are pulling each other, the second zipper has only the connection function, while has no pulling force for dragging, to the top surface and the armrest side surface on the seat cushion. In addition, since the opposite surfaces of the first and second cloth strap outside surfaces of the first and second zippers abut against each other, so that they have no function of dragging the top surface, thus not only is the seat cushion seamlessly connected with the armrest, but also the strength between the seat cushion and the armrest is improved due to the mutually abutting caused by the seamless connection. Similarly, when two seat cushions are connected together by the first zipper, there is also the above effect, thereby ensuring the connection strength between the two seat cushions.

DETAILED DESCRIPTION

Specific embodiments of the present invention are further described in detail below. It should be understood that the description of the embodiments of the present invention here are not intended to limit the protection scope of the present invention.

Figure 1:
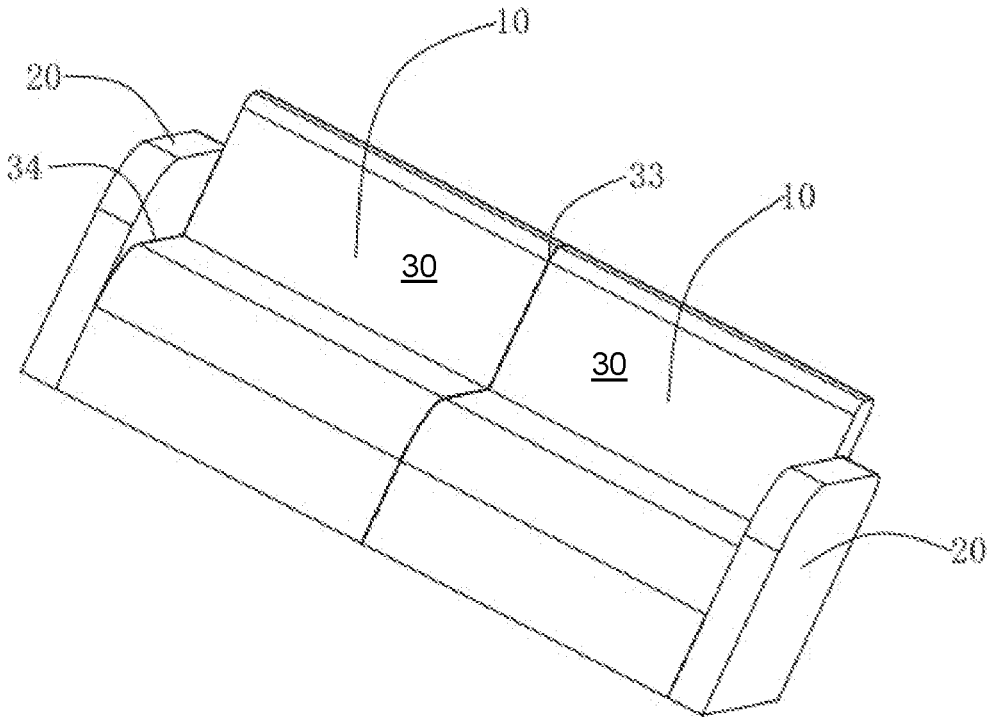
FIG. 1 is a structural schematic view of a compressible sectional sofa provided by the present invention.
Figure 2:
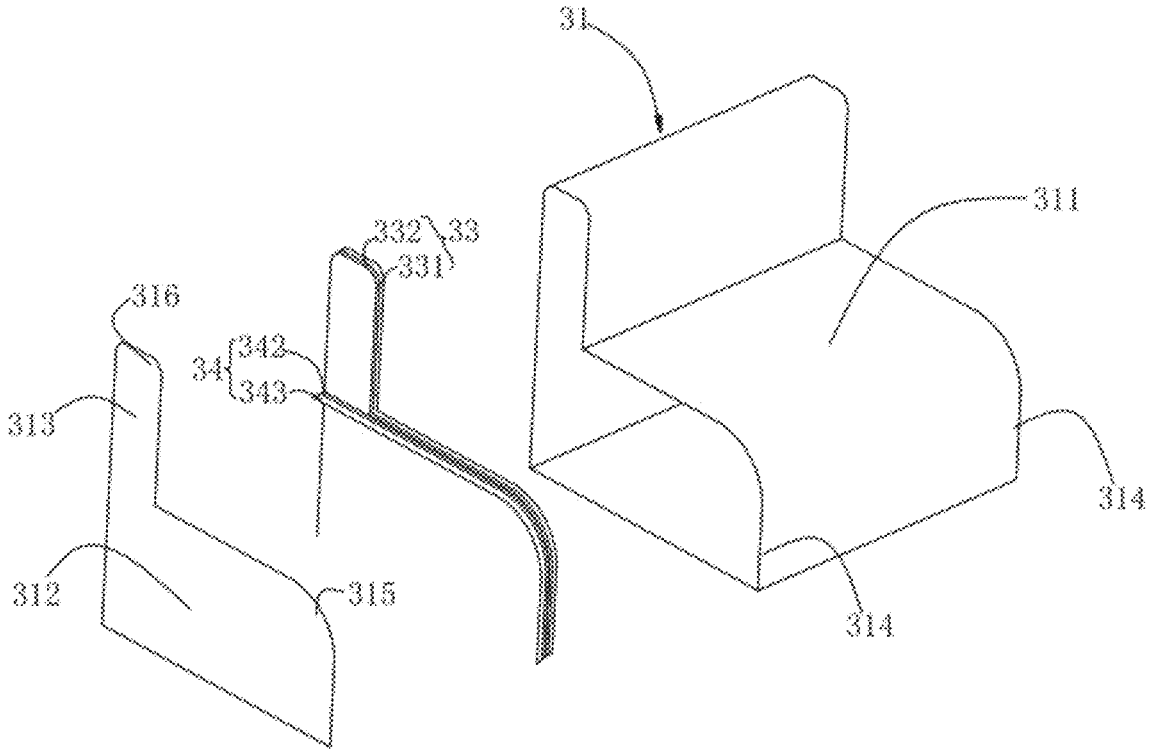
FIG. 2 is a structural schematic view of a seat cushion cover body included in the compressible sectional sofa in FIG. 1.
Figure 3:
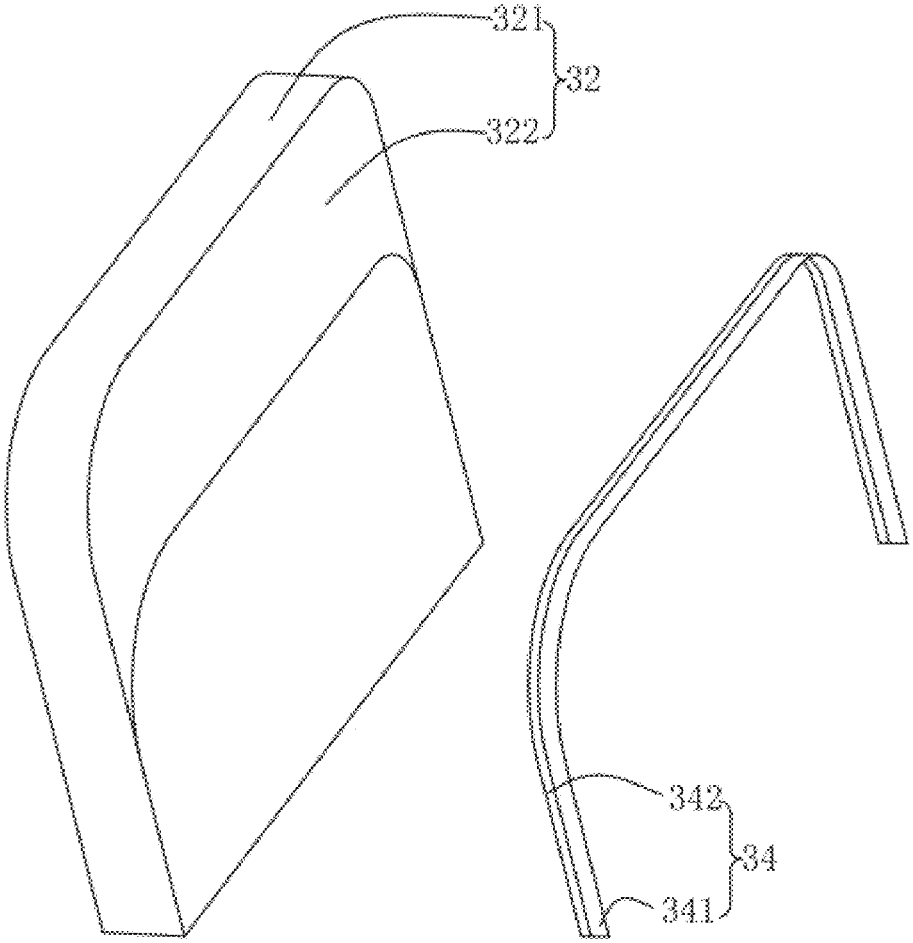
FIG. 3 is a structural schematic view of an armrest cover body included in the compressible sectional sofa in FIG. 1.

As shown in FIG. 1 to FIG. 3, which are structural schematic views of a compressible sectional sofa provided by the present invention. The compressible sectional sofa includes at least one seat cushion 10, at least one armrest 20 disposed at a side of the seat cushion 10, and a cover assembly 30 covering outside the seat cushion 10 and the armrest 20. It can be expected that the compressible sectional sofa further includes other functional components, such as pillows and the like, which are technologies familiar to technical personnel in this field and will not be repeated here.

The shape of the seat cushion 10 itself should be in the prior art, it can be designed based on actual needs and will not be repeated here. It can be expected that the seat cushion 10 can be an L-shaped structure which has a seat portion and a backrest portion. The seat cushion 10 is made of hard material and soft material covering the hard material. The hard material is made of compressible hard sponge, such as sponge made of polyester fiber material, which provides a support function to maintain the shape of the seat cushion 10. The soft material can be made of polyurethane material, which is used to improve use comfort of the seat cushion 10. At the same time, in order to ensure the connection stability between the hard sponge and the soft material, the hard material and the soft material can be integrally formed by injection molding, and it is also possible to dispose an adhesive layer between the hard material and the soft material. The adhesive layer can be non-woven fabric with double-sided adhesive disposed thereon, so as to adhere and fix the hard material and the soft material. The number of the seat cushion 10 should be at least one, it can be expected that the number of the seat cushion 10 can be set based on actual needs. In this embodiment, only for describing the structure and the working principle of the present invention, the number of the seat cushion 10 is two.

The shape of the armrest 20 itself should be in the prior art, it can also be designed as different structures and shapes according to actual needs and will not be described in detail here. It can be expected that a height of the armrest 20 should be larger than that of the seat portion of the seat cushion 10, but less than the backrest portion. The armrest 20 and the seat cushion 10 are disposed separately, and are connected together through the cover assembly 30. Similar to the seat cushion 10, the armrest 20 is made of hard material and soft material covering the hard material. The hard material is made of compressible hard sponge, such as sponge made of polyester fiber material, which provides a support function to maintain the shape of the armrest 20. The soft material can be made of one of polyurethane materials, flexible sponge, and cotton cloth, which is used to improve use comfort of the armrest 20. At the same time, in order to ensure the connection stability between the hard sponge and the soft material, the hard material and the soft material can be integrally formed by injection molding, and it is also possible to dispose an adhesive layer between the hard material and the soft material. The adhesive layer can be non-woven fabric with double-sided adhesive disposed thereon, so as to adhere and fix the hard material and the soft material. The number of the armrest 20 should also be at least one, but generally two. Of course, based on actual cases, the number of the armrest 20 can also be three or more.

Regarding the connection manner between the seat cushion 10 and the armrest 20, they are connected together through the cover body 30, therefore the connection strength of the cover assembly 30 will decide the strength between the seat cushion 10 and the armrest 20, and will decide the quality of the compressible section sofa and whether it conforms experience requirement of users, that is, when a user is sitting on the sectional sofa, the sofa should not lean left or right, even collapse, and then cause partition and separation between the seat cushion 10 and the armrest 20. The cover assembly 30 covers outsides of the seat cushion 10 and the armrest 20, and includes a seat cushion cover body 31 covering on the seat cushion 10, at least one armrest cover body 32 connected to the seat cushion cover body 31, a first zipper 33 disposed on the seat cushion cover body 31 and configured to connect between two adjacent seat cushions 10, and a second zipper 34 respectively disposed on the seat cushion cover body 31 and the armrest cover body 32 and configured to connect the seat cushion cover body 31 and the armrest cover body 32.

The seat cushion cover body 31 includes a top surface 311, at least one armrest side surface 312 connected with the top surface 311, and at least one headrest side surface 313 connected with the top surface 311. The seat cushion cover body 31 itself can be made of cotton fabric and then stitched together to achieve the purpose of wrinkle resistance. The top surface 11 covers at the top of the seat cushion, and the armrest side surface 312 is disposed at a position of the seat cushion 10 connected to the armrest 20. The headrest side surface 313 is disposed at a side of the backrest portion of the seat cushion 10. The first and second zippers 33, 34 are respectively disposed and sewn at joints among the top surface 311, the armrest side surface 312, and the headrest side surface 313. At the same time, by sewing the first, second zippers 33, 34, when the two seat cushions 10 are connected together, and the seat cushion 10 and the armrest 20 are connected together, the connection strength between the seat cushions 10 and between the seat cushion 10 and the armrest 20 is enhanced. The top surface 311 has at least one top outside edge surface 314. In this embodiment, the top surface 311 has two top outside edge surfaces 314. The armrest side surface 312 has an armrest outside edge surface 315, and the headrest side surface 313 has a headrest outside edge surface 316. The top outside edge surface 314, the armrest outside edge surface 315, and the headrest outside edge surface 316 are sewn together to achieve the purpose of manufacturing the seat cushion cover body 31.

The first zipper 33 itself is in the prior art, it includes two first cloth straps 331 and two pieces of first zipper teeth 332 respectively sewn on the first cloth straps 331. Of course, the first zipper 33 is further provided with a pulling head and a pulling piece, which are not repeated here. An side of the first cloth strap 331 facing the pulling piece has a first cloth strap outside surface 333. One first cloth strap 331 of the first zipper 33 and the first zipper teeth 332 disposed thereon are sewn on the seat cushion cover body 31 on one seat cushion 10, and the other first cloth strap 331 is sewn on the seat cushion cover body 31 on the other seat cushion 10, such that the two seat cushions 10 can be connected together when the first zipper 33 is pulled to mesh together. When sewing the first zipper 33, the first cloth strap outside surface 333 should abut against and be sewn together with the top outside edge surface 314 of the top surface 311, at the same time, the first cloth strap outside surface 333 abuts against and is sewn together with the armrest outside edge surface 315 of the armrest side surface 312 and the headrest outside edge surface 316 of the headrest side surface 313.

The second zipper 34 itself is also in the prior art, its structure is the same as that of the first zipper 33, and it also includes two second cloth straps 341 and two pieces of second zipper teeth 342 respectively sewn on the second cloth straps 341. Of course, the second zipper 34 is further provided with a pulling head and a pulling piece, which are not repeated here. An side of the second cloth strap 341 facing the pulling piece has a second cloth strap outside surface 343. One second cloth strap 341 of the second zipper 34 is sewn between the top outside edge surface 314 of the top surface 311 of the seat cushion cover body 31 and the armrest outside edge surface 315 of the armrest side surface 312, and the second cloth strap outside surface 343 of the second cloth strap 341 abuts against and is sewn together with the top outside edge surface 314 and the armrest outside edge surface 315. The other second cloth strap 341 of the second zipper 34 is sewn on the armrest cover body 32, and the sewing method will be described in detailed below. At the same time, since in this embodiment the sofa has two seat cushions 10, in this case, the seat cushion cover body 31 on each of the seat cushions 10 includes two first cloth straps 331 respectively disposed in the first zippers 33 at two sides of the seat cushion 31, and two second cloth straps 341 respectively disposed in the second zippers 34 at two sides of the seat cushion 31. Based on the same principle, in embodiments in which the compressible sectional sofa includes at least two seat cushions 10, the cover assembly 30 can include at least two first zippers 33 and at least two second zippers 34, two opposite sides of each of the at least two seat cushion cover bodies 31 are respectively provided with two first cloth straps 331 of two different first zippers 33, and two second cloth straps 341 of two different second zippers 34.

The armrest cover body 32, similar to the seat cushion cover body 31, also includes a top surface 321 and two side surfaces 322 connected with the top surface 321. The top surface 321 has a top outside edge surface 323. The side surface 322 has a side outside edge surface 324. The second cloth strap outside surface 343 of the second cloth strap 341 of the second zipper 34 abuts against and is sewn together with the top outside edge surface 323 and the side outside edge surface 324 respectively. When the two pieces of second zipper teeth 342 of the second zipper 34 are pulled to mesh together, the armrest 20 and the seat cushion 10 can be connected together.

In assembly, first, the cover assembly 30 is respectively covered on the seat cushion 10 and the armrest 20, then the first, second zippers 33, 34 are respectively pulled to mesh together, thus the sectional sofa can be combined. Of course, when multiple seat cushions 10 are needed, the multiple seat cushions 10 can be assembled by the first zippers 33 pulled to mesh together. Since the compressible sectional sofa does not use non-deformable material such as metal or wood to fabricate, when transportation is needed, first the compressible sectional sofa is compressed by machine equipments to compress and discharge air, so that its volume can be reduced, and it is placed into a plastic bag or box, as long as the strength of the plastic bag or box should be larger than a resilience force of the compressible sectional sofa. During use, as long as the compressed sectional sofa is taken out of the plastic bag or box and unfolded using its inherent resilience force, it can be directly used.

Compared with the prior art, in the compressible sectional sofa provided by the present invention, since both the seat cushion 10 and the armrest 20 are made of compressible hard material and soft material, when transportation is needed, the seat cushion and the armrest can be compressed by machine equipments, such that air in the hard material and the soft material is squeezed out, and volumes of the seat cushion 10 and the armrest 20 are reduced, thus the package volume can be reduced to facilitate transportation; at the same time, during each transportation, the same container can be loaded three to four times more, thereby achieving the purpose of reducing transportation cost. At the same time, since the sofa is composed of the seat cushion 10 and the armrest 20, how to connect the seat cushion 10 and the armrest 20 and how to ensure the strength between the seat cushion 10 and the armrest 20 are very important, otherwise the compressible sectional sofa is unable to use. Therefore, the cover assembly 30 uses the zippers to fix the seat cushion 10 and the armrest 20; in order to improve the connection strength between the seat cushion 10 and the armrest 20, the first cloth strap outside surface 333 of the first zipper 33 abuts against and is sewn with the armrest outside edge surface 315, the second cloth strap outside surface 343 abuts against and is sewn with the top outside edge surface 314, and the opposite surfaces of the first cloth strap outside surface 333 and of the second cloth strap outside surface 343 are sewn, such that when one side of the second zipper 34 at the seat cushion 10 and another side of the second zipper 34 at the armrest 20 are pulling each other, the second zipper 34 has only the connection function, while has no pulling force for dragging, to the top surface 311 and the armrest side surface 312 on the seat cushion 10. In addition, since the opposite surfaces of the first and second cloth strap outside surfaces 333, 334 of the first and second zippers 33, 34 abut against each other, so that they have no function of dragging the top surface 311, thus not only is the seat cushion 10 seamlessly connected with the armrest 20, but also the strength between the seat cushion 10 and the armrest 20 is improved due to the mutually abutting caused by the seamless connection. Similarly, when two seat cushions 10 are connected together by the first zipper 33, there is also the above effect, thereby ensuring the connection strength between the two seat cushions 10.

The above are only preferred embodiments of the present invention and are not intended to limit the protection scope of the present invention. Any modification, equivalent replacement, or improvement within the spirit of the present invention is covered within the claim scope of the present invention.

What is claimed is:

1. A compressible sectional sofa, wherein the compressible sectional sofa comprises at least one seat cushion, at least one armrest disposed at a side of the seat cushion, and a cover assembly covering outside the seat cushion and the armrest; both the seat cushion and the armrest are made of compressible material; the seat cushion and the armrest are disposed separately, the cover assembly comprises a seat cushion cover body covering on the seat cushion, at least one armrest cover body connected to the seat cushion cover body and covering on the armrest, and a second zipper disposed on both the seat cushion cover body and the armrest cover body and configured to connect the seat cushion cover body and the armrest cover body;

wherein the compressible sectional sofa comprises at least two seat cushions, the cover assembly comprises at least two seat cushion cover bodies respectively covering on the at least two seat cushions, and the cover assembly further comprises a first zipper disposed between the at least two seat cushion cover bodies and configured to connect the at least two seat cushion cover bodies with each other;

wherein both the seat cushion and the armrest are made of hard material and soft material covering the hard material, both the hard material and the soft material are compressible material.

2. The compressible sectional sofa according to claim 1, wherein the hard material is hard sponge.

3. The compressible sectional sofa according to claim 1, wherein the soft material is one of flexible sponge and cotton cloth.

4. The compressible sectional sofa according to claim 1, wherein between the hard material and the soft material there is further provided with an adhesive layer.

5. The compressible sectional sofa according to claim 1, wherein the hard material and the soft material are integrally formed by injection molding.

6. The compressible sectional sofa according to claim 1, wherein both the hard material and the soft material are capable of being compressed to remove air therein and thereby reduce the volume of the compressible sectional sofa.

7. A compressible sectional sofa, wherein the compressible sectional sofa comprises at least one seat cushion, at least one armrest disposed at a side of the seat cushion, and a cover assembly covering outside the seat cushion and the armrest; both the seat cushion and the armrest are made of compressible material; the seat cushion and the armrest are disposed separately, the cover assembly comprises a seat cushion cover body covering on the seat cushion, at least one armrest cover body connected to the seat cushion cover body and covering on the armrest, and a second zipper disposed on both the seat cushion cover body and the armrest cover body and configured to connect the seat cushion cover body and the armrest cover body;

wherein the compressible sectional sofa comprises at least two seat cushions, the cover assembly comprises at least two seat cushion cover bodies respectively covering on the at least two seat cushions, and the cover assembly further comprises a first zipper disposed between the at least two seat cushion cover bodies and configured to connect the at least two seat cushion cover bodies with each other;

wherein the seat cushion cover body comprises a top surface, at least one armrest side surface connected with the top surface, and at least one headrest side surface connected with the top surface; the top surface has at least one top outside edge surface, the armrest side surface has at least one armrest outside edge surface, the headrest side surface has at least one headrest outside edge surface; the second zipper has two second cloth straps, each second cloth strap has a second cloth strap outside surface, one of the second cloth strap outside surfaces abuts against the armrest outside edge surface, and one of the second cloth straps of the second zipper is fixed to the armrest cover body to connect the armrest cover body and the seat cushion cover body.

8. The compressible sectional sofa according to claim 7, wherein the first zipper has two first cloth straps, each first cloth strap has a first cloth strap outside surface, one of the first cloth strap outside surfaces abuts against the top outside edge surface and the headrest outside edge surface.

9. The compressible sectional sofa according to claim 8, wherein the cover assembly comprises at least two first zippers and at least two second zippers, two opposite sides of each of the at least two seat cushion cover bodies are respectively provided with two first cloth straps of two first zippers, and two second cloth straps of two second zippers.

10. The compressible sectional sofa according to claim 7, wherein one of the first cloth strap outside surfaces is sewn together with the top outside edge surface and the headrest outside edge surface.

11. The compressible sectional sofa according to claim 7, wherein one of the second cloth strap outside surfaces abuts against and is sewn together with the armrest outside edge surface, and an opposite side of the first cloth strap outside surface abuts against and is sewn together with an opposite side of the second cloth strap outside surface.

* * * * *